US010128010B2

(12) United States Patent
Miyazaki

(10) Patent No.: US 10,128,010 B2
(45) Date of Patent: Nov. 13, 2018

(54) RADIATION SHIELDING MATERIAL AND PRODUCTION METHOD THEREFOR

(71) Applicant: Tokuyama Corporation, Shunan-shi, Yamaguchi (JP)

(72) Inventor: Kojiro Miyazaki, Shunan (JP)

(73) Assignee: Tokuyama Corporation, Shunan-shi, Yamaguchi (JP)

( * ) Notice: Subject to any disclaimer, the term of this patent is extended or adjusted under 35 U.S.C. 154(b) by 37 days.

(21) Appl. No.: 15/536,578

(22) PCT Filed: Dec. 14, 2015

(86) PCT No.: PCT/JP2015/084926

§ 371 (c)(1),
(2) Date: Jun. 15, 2017

(87) PCT Pub. No.: WO2016/098725

PCT Pub. Date: Jun. 23, 2016

(65) Prior Publication Data

US 2017/0337996 A1 Nov. 23, 2017

(30) Foreign Application Priority Data

Dec. 15, 2014 (JP) ..... 2014-253154

(51) Int. Cl.

| | |
|---|---|
| ***G21F 1/10*** | (2006.01) |
| ***G21F 3/00*** | (2006.01) |
| ***G21F 5/00*** | (2006.01) |
| ***G21F 5/018*** | (2006.01) |
| ***G21F 3/02*** | (2006.01) |
| ***G21F 5/002*** | (2006.01) |

(52) U.S. Cl.
CPC ..... *G21F 1/103* (2013.01); *G21F 1/10* (2013.01); *G21F 3/00* (2013.01); *G21F 3/02* (2013.01); *G21F 5/00* (2013.01); *G21F 5/002* (2013.01); *G21F 5/018* (2013.01)

(58) Field of Classification Search
CPC ... G21F 1/10; G21F 1/103; G21F 3/00; G21F 3/02; G21F 5/00; G21F 5/002; G21F 5/18
See application file for complete search history.

(56) References Cited

U.S. PATENT DOCUMENTS

| | | | | |
|---|---|---|---|---|
| 4,203,886 | A | 5/1980 | Hirai et al. | |
| 4,629,746 | A | 12/1986 | Michl et al. | |
| 2006/0151749 | A1 | 7/2006 | Thiess et al. | |
| 2010/0272990 | A1* | 10/2010 | Bondesan | B44C 1/10 428/337 |

FOREIGN PATENT DOCUMENTS

| | | | |
|---|---|---|---|
| EP | 0371699 | A1 | 6/1990 |
| EP | 0372758 | A1 | 6/1990 |
| JP | 54-69698 | A | 6/1979 |
| JP | 61-176508 | A | 8/1986 |
| JP | 2-222895 | A | 9/1990 |
| JP | 2-223899 | A | 9/1990 |
| JP | 2005-529352 | A | 9/2005 |
| JP | 2007-212304 | A | 8/2007 |
| JP | 2013-127021 | A | 6/2013 |
| JP | 2013-181793 | A | 9/2013 |

OTHER PUBLICATIONS

International Search Report in International Application No. PCT/JP2015/084926, filed Dec. 14, 2015.

* cited by examiner

*Primary Examiner* — Nicole Ippolito
*Assistant Examiner* — Sean Luck
(74) *Attorney, Agent, or Firm* — Saliwanchik, Lloyd & Eisenschenk

(57) ABSTRACT

[Object] To provide a radiation shielding material that includes a resin composition obtained by filling a matrix formed of resin with a radiation-absorbing substance and is capable of obtaining a structure in which transparency is significantly improved as compared with the conventional radiation shielding material while having a radiation shielding effect similar to that of the conventional radiation shielding material. [Solving Means] A radiation shielding material includes: a resin composition containing a proportion of 20 to 80 vol % of fluoride powder containing barium as a constituent element. The fluoride powder is favorably barium fluoride or lithium barium fluoride, the resin favorably has a refractive index (n) of 1.4 to 1.6, and particularly, a difference between a refractive index of the resin and a refractive index of the fluoride powder is favorably within ±0.05.

19 Claims, No Drawings

RADIATION SHIELDING MATERIAL AND PRODUCTION METHOD THEREFOR

CROSS-REFERENCE TO RELATED APPLICATIONS

This application is the U.S. national stage application of International Patent Application No. PCT/JP2015/084926, filed Dec. 14, 2015, which claims priority to Japanese Application No. 2014-253154, filed Dec. 15, 2014, the disclosures of each of which are incorporated herein by reference in their entirety.

TECHNICAL FIELD

The present invention relates to a new shielding material that shields radiation such as X-rays and γ-rays and a production method therefor. Specifically, it provides a radiation shielding material that constitutes a molded body having an arbitrary shape and is capable of adding a radiation shielding effect that prevents radiation from being transmitted from a surface to which the radiation is applied to a back surface in the molded body, and transparency to the material.

BACKGROUND ART

Conventionally, various materials have been provided as a radiation shielding material for reducing the amount of radiation from a substance that emits radiation such as a gas, a liquid, and a solid (hereinafter, collectively referred to as radioactive substances in some cases), and a typical material thereof is lead. However, although lead has an excellent radiation shielding effect, the lead itself has a poor workability and the use range of lead is limited, e.g., it is used by being embedded in a wall of a simple structure such as a box in a plate-like material form. Further, also lead glass has a high radiation shielding effect but is brittle because it is glass. In addition, it is heavy. Therefore, the use range of lead glass is limited similarly to lead.

As compared with the above-mentioned lead or lead glass, a radiation shielding material obtained by filling resin with powder having a radiation absorbing effect has a lower shielding effect. However, because the radiation shielding material is light and can be molded in various shapes, it is expected as a material that can be processed into a structure such as a vessel, a pipe, a protector, and a syringe.

For example, a radiation shielding material obtained by filling resin with metal powder such as lead and tungsten and a compound such as barium sulfate is provided (see Patent Literatures 1 to 3).

However, the above-mentioned metal-based radiation shielding material has such a problem that the material becomes heavier when the filling amount is increased to improve the radiation shielding effect. Furthermore, because lead is a toxic substance, such a problem that use of lead is being limited occurs.

Meanwhile, because the compound-based filler such as barium sulfate is relatively light and has a certain level of radiation shielding effect, it is favorably used.

Meanwhile, the conventionally-proposed radiation shielding material is a non-transparent material except for the lead glass, and just has to be used at the expense of transparency that is necessary to check the content to be shielded its radiation.

Further, as a transparent resin material for radiographic visualization in the field of dentistry, also those obtained by filling nanoparticles smaller than a wavelength of visible light have been proposed (see Patent Literature 4). However, the nanoparticles are difficult to disperse in filling, and a sufficient amount of nanoparticles cannot be filled. Therefore, it is difficult to achieve a sufficient shielding effect and such a problem that the transparency is significantly reduced when the filling amount is increased may occur.

Patent Document 1: Japanese Patent Application Laid-open No. 2007-212304

Patent Document 2: Japanese Patent Application Laid-open No. 2013-127021

Patent Document 3: Japanese Patent Application Laid-open No. 2013-181793

Patent Document 4: Japanese Patent Application Laid-open No. 1986-176508

SUMMARY OF INVENTION

Problem to be Solved by the Invention

In view of the above, it is an object of the present invention to provide a radiation shielding material that includes a resin composition obtained by filling a matrix formed of resin with a radiation-absorbing substance and is capable of obtaining a structure in which transparency is significantly improved as compared with the conventional radiation shielding material while having a radiation shielding effect similar to that of the conventional radiation shielding material.

Means for Solving the Problem

A radiation shielding material according to an embodiment of the present invention includes: a resin composition containing a proportion of 20 to 80 vol % of fluoride powder containing barium as a constituent element.

A molded body according to an embodiment of the radiation shielding material of the present invention is a molded body including a filling layer formed of a resin composition obtained by filling metal fluoride powder in resin, wherein a density of the metal fluoride powder is not less than 4.6 g/cm$^3$, a difference between a refractive index of the resin and a refractive index of the metal fluoride powder is within ±0.07, and a part or whole of the filling layer in a thickness direction includes a layer in which a filling rate of the metal fluoride powder is not less than 40 vol %.

A typical production method for the radiation shielding material of the present invention includes: preparing resin and metal fluoride powder, wherein a difference between a refractive index of the resin and a refractive index of the metal fluoride powder is within ±0.07, and a density of the metal fluoride powder is not less than 4.6 g/cm$^3$; preparing a resin composition including the resin and the metal fluoride powder; and molding the resin composition, wherein at least a part of the resin composition including a layer in which a filling rate of the metal fluoride powder is not less than 40 vol %.

Effects of the Invention

According to the present invention, it is possible to obtain a structure in which transparency is improved as compared with the conventional radiation shielding material while having a radiation shielding effect similar to that of the conventional radiation shielding material.

MODES FOR CARRYING OUT THE INVENTION

The present inventors has found that fluoride containing barium as a constituent element has not only excellent radiation absorbing properties but also high transparency when it is filled in resin such as vinyl chloride resin used as a molding material for general purposes as compared with the conventionally-proposed compound, and completed the present invention.

Specifically, a radiation shielding material according to an embodiment of the present invention is characterized by including a resin composition containing a proportion of 20 to 80 vol % of fluoride powder containing barium as a constituent element (hereinafter, referred to also as the BaF powder).

In the radiation shielding material according to this embodiment, barium fluoride, lithium barium fluoride, or the like is favorable as the BaF powder.

Further, as resin to be used, those having a refractive index (n) of 1.4 to 1.6 are favorable in order to improve transparency in the combination with the BaF powder. Specifically, examples of the resin include, but of course not limited to polyvinyl chloride resin, polyacrylic acid resin, and silicone resin.

In particular, in the above-mentioned combination of the resin and the fluoride powder, the difference between the refractive index of the resin and the refractive index of the fluoride powder is favorably within ±0.05 (the absolute value of the difference between the refractive index of the resin and the refractive index of the fluoride powder is not more than 0.05, the same applies hereinafter). In the case where the difference of the refractive index is within this range, it is possible to achieve the total light transmittance of a molded body having a thickness of 4 mm of not less than 60%, for example.

Furthermore, in the radiation shielding material according to this embodiment, the average particle diameter of the fluoride powder is favorably 10 to 500 for example, in order to further exert transparency.

Although the BaF powder used for the radiation shielding material according to this embodiment has a high density, the refractive index thereof is low and can be closer to a refractive index of general-purpose transparent resin. Therefore, it is possible to add high transparency to a resin composition filled with this. Furthermore, the BaF powder has excellent radiation absorbing properties associated with the high density, and is capable of exerting a radiation shielding effect similar to that of the conventional radiation shielding material.

Further, in the case where the BaF powder containing lithium is filled in the radiation shielding material according to this embodiment, it is possible to effectively shield even neutrons.

As described above, the providing of a material having transparency in the radiation shielding material is made for the first time in the present disclosure, and it is expected to be used to mold the radiation shielding material in an arbitrary shape to achieve a structure and for the application in which transparency is necessary to check the content to be shielded its radiation.

Examples of the application include a transport pipe in which the state of fluid passing therethrough can be checked, a container in which the state of content can be checked, a radiation shielding plate, a sheet, a cylinder of a syringe, and an outer cylinder member.

Hereinafter, this embodiment will be described in detail.

[BaF Powder]

In this embodiment, the BaF powder is not particularly limited as long as it is fluoride powder containing at least barium as a constituent element. Examples of the BaF powder include barium fluoride, lithium barium fluoride, and yttrium barium fluoride. With the BaF powder having a crystalline structure with a cubic crystal system, a radiation shielding material having excellent transparency can be obtained because there is no reduction in transparency due to crystal birefringence when the BaF powder is filled in resin as powder. Examples of barium-containing fluoride with a cubic crystal system include barium fluoride and lithium barium fluoride. Further, two or more kinds of BaF powder may be mixed and used. In particular, lithium barium fluoride contains lithium as a constituent element, and it is possible to add shielding properties for neutrons to the radiation shielding material according to the present invention by using lithium barium fluoride as the BaF powder.

Most of, specifically, not less than 80% by mass, particularly, not less than 90% by mass, of the BaF powder is favorably formed of a single particle. Specifically, the BaF powder containing many aggregates is hard to mix when being filled in resin due to high viscosity, and is likely to contain air bubbles, which may reduce the transparency of a radiation shielding material formed of the resulting resin composition.

The BaF powder is a single crystal. Examples of the method of obtaining the single particle include a method of producing a bulk single crystal, pulverizing the bulk single crystal, and classifying it.

Note that as the method of producing the single crystal, a well-known method such as a pulling up method, a Bridgman method, a VGF method, an EFG method, and a casting method can be used.

For pulverizing the single crystal, a well-known method such as a hammer mill, a roller mill, and a mortar can be used without limitation. Further, after the pulverization, it is favorable to remove fines and coarse particles by means of an air classifier, a sieve, or the like.

Further, the average particle diameter of the BaF powder is favorably 10 to 500 μm, particularly, 20 to 200 μm. In the case where the average particle diameter is less than 10 μm, it is likely to agglomerate when being mixed with resin, and the viscosity thereof is high. Accordingly, it tends to be hard to highly fill the BaF powder. Further, in the case where the average particle diameter is larger than 500 μm, a surface of a molded body tends to be roughened and the molded body tends to be brittle, which reduces the mechanical strength.

[Resin]

In this embodiment, the resin is not particularly limited as long as it has transparency. Typical examples of the resin include polyvinyl chloride, polyvinylidene chloride, polystyrene, a styrene butadiene copolymer, polycarbonate, acrylic resin, polyethylene terephthalate, polybutylene terephthalate, polymethylmethacrylate, polyvinyl acetate, polyethylene, an ethylene copolymer, polyvinyl acetate, silicone resin, epoxy resin, and phenol resin.

Among them, those having the refractive index (n) of 1.4 to 1.6 are favorable in order to improve transparency in the combination with the BaF powder. Specifically, polyvinyl chloride resin, polyacrylic acid resin, silicone resin, and an ethylene copolymer are favorable.

Note that for example, the refractive indices of a barium fluoride single crystal and a lithium barium fluoride single crystal out of raw materials of the BaF powder are respectively 1.48 and 1.54.

In order to express transparency of the radiation shielding material according to this embodiment more favorably, the refractive index of resin to be used needs to be close to that of the BaF powder. The difference between the refractive index of the resin and the refractive index of the BaF powder is favorably ±0.05, particularly, ±0.03. For example, lithium barium fluoride and polyvinyl chloride have substantially the same value of refractive index of 1.54, and this combination is particularly favorable in order to express transparency.

Further, in the case where the difference between the refractive index of the BaF and the refractive index of the resin is large, it is possible to improve the transparency more by adjusting the component or the molecular weight of resin, or employing a means for adjusting the kind or additive amount of a plasticizer in the case where the plasticizer is used and adjusting the refractive index of the resin to be closer to the refractive index of the BaF powder.

[Proportion of BaF Powder and Resin in Radiation Shielding Material]

In the present invention, the BaF powder is filled in resin at a rate of 20 to 80 vol %, favorably, 50 to 75 vol %.

In the case where the filling amount of the BaF powder is less than 20 vol %, the radiation shielding effect is not sufficient. Further, in the case where the filling amount of the BaF powder is larger than 75 vol %, the transparency is reduced and the reduction in the strength of the molded body is significant.

The filling amount of the BaF powder is selected to be optimal depending on the use form of the molded body or the intended use. For example, less than 60 vol % is selected in the case where the flexibility or lightness of the molded body is prioritized, and not less than 60 vol % is selected in the case where the radiation shielding effect is prioritized.

[Other Arbitrary Additives in Radiation Shielding Material]

To the radiation shielding material according to this embodiment, a well-known additive that does not adversely affect the effects of this embodiment in addition to the above-mentioned components can be added in a well-known proportion.

Examples of the additive include a plasticizer, a thermal stabilizer, an antioxidant, an antistatic agent, a lubricant, a processing aid, and colorant. Further, two or more kinds of these additives also can be combined and used as necessary.

[Mixing Method and Molding Method]

In this embodiment, a method of mixing resin and the BaF powder to obtain a resin composition constituting a radiation shielding material can be employed from well-known methods depending on the properties of resin to be used or the average particle diameter or filling amount of the BaF powder. For example, in the case of thermoplastic resin such as polyvinyl chloride and an ethylene copolymer, a method of obtaining, after mixing resin and the BaF powder well by using a mixer or the like in advance, a resin composition by kneading the resin while heat-melting the resin by a Banbury mixer, an extruding machine, or the like, is used. The obtained resin composition can be molded by a molding machine after being temporarily solidified in, for example, a pellet state, or can be molded while maintaining the melting of the resin. As the molding method, a well-known method such as injection molding, extrusion molding, press molding, calendar molding, and blow molding can be employed.

Further, in the case of silicone resin, epoxy resin, or the like, it is possible to obtain a molded body by mixing a liquid monomer and the BaF powder by using a mixer or the like at room temperature to prepare a slurry, pouring the slurry into a mold, and solidifying it by a method such as heating and ultraviolet irradiation.

In any of the mixing, in the case where there are air bubbles between the resin and the BaF powder, it is favorable to perform degassing processing such as vacuum degassing while the resin has fluidity in order to remove the air bubbles to prevent the transparency from being reduced.

[Application of Radiation Shielding Material]

The radiation shielding material according to this embodiment can be processed in an arbitrary structure by an appropriate molding method, and used for arbitrary application in which transparency is necessary to check the content to be shielded its radiation without particular limitation. Further, because it is transparent, it can be easily colored, and widely and favorably used for not only industrial materials but also daily commodities and household products, and the like.

For example, a pipe for transporting liquid containing a radioactive substance, a container for transporting and storing a radioactive substance, a syringe for radioactive substance-containing liquid, a facepiece for shielding radiation, a lens part of goggles and spectacles, a helmet, protective clothing, an apron, a shoe sole, a shield, a partition, a curtain, a blind curtain, an accordion curtain, a window of heavy equipment or the like, a building material such as a flooring material, a window, and a wall material, a plates and sheet that can be used for multiple purposes, and the like are exemplified. Examples of the application of the plate and sheet include applications to a cover for storage space of a radioactive substance and radioactive waste, a leisure sheet, stick-on application on a window glasses, and the like.

Furthermore, the radiation shielding material according to this embodiment can be used for those other than a structure having a fixed shape such as a molded body. Specifically, the radiation shielding material according to this embodiment may have an indefinite shape, e.g., it may be liquid or pasty. For example, it may be used as a repairing material, a filler or a caulking material for other building materials such as asphalt, glass, a flooring material, and a wall material.

The present inventors have further found that, because refractive index of metal fluoride containing the above-mentioned fluoride containing barium as a constituent element, which has a predetermined density or more, is unexpectedly not large with respect to the high density, the metal fluoride has excellent radiation absorbing properties and the refractive index thereof is close to that of resin such as vinyl chloride resin that is generally used as a molding material and easy to be made closer to that of resin. On the basis of the above findings, it has been found that it is possible to obtain a radiation material formed of a resin molded body having extremely high transparency and excellent radiation shielding properties by using the above-mentioned metal fluoride as a filler that can be highly filled and has relatively larger particle size to form a layer containing a high concentration of metal fluoride, and adjusting the difference between the refractive index of the metal fluoride and the refractive index of the resin to be within a particular range.

Specifically, the molded body according to an embodiment of the radiation shielding material of the present invention is a molded body including a filling layer formed of a resin composition obtained by filling resin with metal fluoride powder. The density of the metal fluoride powder is not less than 4.6 g/cm$^3$. The difference between the refractive index of the resin and the refractive index of the metal fluoride powder is within ±0.07 (the absolute value of the difference between the refractive index of the resin and the refractive index of the metal fluoride powder is not more than 0.07, the same applies hereinafter), favorably, within ±0.05, and particularly, within ±0.03. A part or whole of the filling layer in the thickness direction includes a layer in which the filling rate of the metal fluoride powder is not less than 40 vol %, particularly, not less than 50 vol %, further, not less than 60 vol %.

Further, a production method for a radiation shielding material according to an embodiment of the present invention includes; preparing resin and metal fluoride powder, wherein a difference between a refractive index of the resin and a refractive index of the metal fluoride powder is within ±0.07, favorably within ±0.05, and particularly, within ±0.03, and a density of the metal fluoride powder is not less than 4.6 g/cm$^3$; preparing a resin composition including the resin and the metal fluoride powder; and molding the resin composition, wherein at least a part of the resin composition including a layer in which a filling rate of the metal fluoride powder is not less than 40 vol %, particularly, not less than 50 vol %, further, not less than 60 vol %.

A molded body of the resin composition has a first surface to be irradiated with radiation and a second surface opposite to the first surface, and a radiation shielding effect that prevents radiation from being transmitted from the first surface to the second surface. Then, the filling layer is typically located on a cross-section of the molded body in the thickness direction between the first surface and the second surface, and constitutes at least a part of the cross-section in the thickness direction so as to prevent radiation from being transmitted from the first surface to the second surface. Due to the specific gravity difference between the resin and the metal fluoride powder constituting the resin composition, the metal fluoride powder tends to be distributed in the resin with a predetermined concentration gradient. Also in such a case, because a layer in which the filling rate of the metal fluoride is not less than 40 vol % is located in a direction that is orthogonal to or intersects the transmission direction of radiation in the cross-section in the thickness direction, it is possible to achieve an intended high radiation shielding effect.

The proportion of the thickness of the filling layer in the total thickness of the molded body is not particularly limited, and the thickness of the filling layer may be the total thickness or a part thereof of the molded body. Further, the thickness of the filling layer may be determined by the filling rate of the metal fluoride constituting the filling layer. For example, in order to achieve a certain radiation shielding effect or more effects, the filling layer can be thin when the filling rate of the metal fluoride in the filling layer is relatively high. On the contrary, when the filling rate is relatively low, it only needs to increase the thickness of the filling layer. In any embodiment, in order to achieve the object of the present invention, the filling layer needs to include a layer in which the filling rate of the metal fluoride is not less than 40 vol %, favorably, not less than 50 vol % (hereinafter, referred to also as the high-filling layer). The high-filling layer may constitute a whole or part of the filling layer, and it is favorable that the thickness thereof is not less than 0.5 mm, favorably, not less than 1 mm, further, 2 to 50 mm.

Examples of the metal fluoride constituting the metal fluoride powder according to this embodiment include simple metal fluoride, complex metal fluoride, or a solid solution of a plurality of metal fluorides. Because the refractive index is different depending on the kind of the metal fluoride to be used, it is possible to suppress the difference between the refractive index of the metal fluoride powder and the refractive index of the resin within a predetermined range and improve the transparency of the molded body by selecting the kind of the metal fluoride constituting the metal fluoride powder depending on the kind, refractive index, and the like of the resin to be used.

Examples of the metal fluoride having a density of not less than 4.6 g/cm$^3$ include $BaLiF_3$ single crystal (complex metal fluoride, density of 5.2, refractive index of 1.54), $BaY_2F_8$ (complex metal fluoride, density of 5.0, refractive index of 1.52), $BaF_2$ (simple metal fluoride, density of 4.8, refractive index of 1.48), $LaF_3$ (simple metal fluoride, density of 5.9, refractive index of 1.60), $CeF_3$ (simple metal fluoride, density of 6.2, refractive index of 1.61), $SmF_3$ (simple metal fluoride, density of 6.6, refractive index of 1.62), $YbF_3$ (simple metal fluoride, density of 8.2, refractive index of 1.60), and $BaF_2$—$LaF_3$ (solid solution, density of 5.4, refractive index of 1.54).

Examples of the refractive index of the resin constituting the resin composition typically include, but not particularly limited to, not less than 1.4 and not more than 1.6. Examples of the resin having such a refractive index include epoxy resin, vinyl chloride resin, acrylic resin, cycloolefin resin, silicone resin, and a mixture of at least two or more kinds of them. Further, as the above-mentioned resin, transparent resin is favorable.

[Other Arbitrary Additives in Resin Composition]

To the radiation shielding material according to this embodiment, a well-known additive that does not adversely affect the effects of this embodiment in addition to the above-mentioned components can be added in a well-known proportion.

Examples of the additive include a plasticizer, a thermal stabilizer, an antioxidant, an antistatic agent, a lubricant, a processing aid, and colorant. Further, two or more kinds of these additives also can be combined and used as necessary.

The above-mentioned preparing the metal fluoride powder may include adjusting the refractive index of the metal fluoride powder by making solid solution of the metal fluorides. Specifically, it only needs to prepare two or more fluorides that have different refractive indices and are able to be dissolved each other, such as $BaF_2$ and $LaF_3$, mix them so as to have a desired refractive index, and melt and solidify them to obtain a solid solution. Alternatively, the above-mentioned preparing the resin may include adjusting the refractive index of the resin by a mixture of resins having different refractive indices. Specifically, it only needs to prepare a plurality of kinds of resin having a different refractive index due to the difference of the component or molecular weight of the resin, and mix them so as to have a desired refractive index.

The particle shape of the metal fluoride powder is not particularly limited, and those having an arbitrary shape such as a spherical shape, a scale shape, and an indefinite shape can be used. However, it is favorable to use those having a spherical shape. Accordingly, it is possible to suppress the agglomeration of the metal fluoride powder and relatively easily cause the metal fluoride powder to disperse in the resin in use with the particle diameter to be described later.

The average particle diameter of the metal fluoride powder is favorably not less than 10 μm and not more than 500 μm. In the case where the average particle diameter is less than 10 μm, it is difficult to achieve an intended radiation shielding effect because the metal fluoride powder is hard to disperse when it is filled in the resin and the sufficient filling amount thereof is not achieved. Further, even if the filling amount is increased, the transparency is significantly reduced and intended transparency cannot be ensured. Meanwhile, in the case where the average particle diameter of the metal fluoride powder exceeds 500 μm, the surface of the molded body tends to be roughened and the molded body tends to be brittle, which reduces the mechanical strength. A particularly favorable average particle diameter is 20 to 200 μm.

[Mixing Method and Molding Method]

In this embodiment, the mixing method for forming the resin composition can be employed from well-known methods depending on the properties of resin to be used or the average particle diameter or filling amount of the metal fluoride powder. For example, in the case of thermoplastic resin such as polyvinyl chloride and an ethylene copolymer, a method of obtaining, after mixing resin and the metal fluoride powder well by using a mixer or the like in advance, a resin composition by kneading the resin while heat-melting the resin by a Banbury mixer, an extruding machine, or the like, is used. The obtained resin composition can be molded by a molding machine after being temporarily solidified in, for example, a pellet state, or can be molded while maintaining the melting of the resin. As the molding method, a well-known method such as injection molding, extrusion molding, press molding, calendar molding, and blow molding can be employed.

Further, in the case of silicone resin, epoxy resin, or the like, it is possible to obtain a molded body by mixing a liquid monomer and the metal fluoride powder by using a mixer or the like at room temperature to prepare a slurry, pouring the slurry into a mold, and solidifying it by a method such as heating and ultraviolet irradiation.

In any of the mixing, in the case where there are air bubbles between the resin and the metal fluoride powder, it is favorable to perform degassing processing such as vacuum degassing while the resin has fluidity in order to remove the air bubbles to prevent the transparency from being reduced.

With the molded body having the above-mentioned configuration according to this embodiment, it is possible to achieve total light transmittance of 65% or more or suppress the haze to be not more than 40%. Furthermore, it is possible to obtain a molded body having a radiation shielding effect of 1 mmPb or more of lead equivalent.

As described above, the molded body having high transparency and an excellent radiation shielding effect is relatively light and can be formed into an arbitrary shape such as a plate shape, a sheet shape, and a cylindrical shape. Therefore, the molded body can be easily formed as a lens part of goggles and spectacles, a pipe for transporting liquid containing a radioactive substance, a radiation shielding sheet, a syringe for liquid containing a radioactive substance, and the like.

[Method of Measuring Refractive Index]

The refractive index of resin can be measured by a commercially-available refractometer by using a specimen obtained by curing only the resin. Note that although the refractive index of a substance is different depending on the wavelength of light, generally it only needs to use a sodium D line (589.3 nm) as a light source and measure the refractive index in the wavelength (hereinafter, referred to also as $n_D$). The refractive index in a visible region is generally typified by the $n_D$. Note that in order to obtain a radiation shielding material having high transparency to light having a particular wavelength, it only needs to measure the refractive index by using a light source that emits the wavelength.

The refractive index of the fluoride powder can be measured by using a specimen, obtained by processing an ingot of fluoride, in a way similar to that for the refractive index of the resin. Note that in the case where an ingot of fluoride is hard to obtain and it needs to directly measure the refractive index of the fluoride powder, the refractive index can be obtained by using an immersion method. Specifically, various dispersion media having refractive indices adjusted in units of 0.01 are prepared and the refractive index of the dispersion medium used for one of dispersion liquids obtained by causing fluoride powder to disperse in the dispersion media, which has the highest transparency, can be regarded as the refractive index of the fluoride powder.

[Method of Measuring Thickness of Layer in which there is Fluoride Powder and Filling Rate of Fluoride Powder]

The thickness of a layer in which there is fluoride powder in the radiation shielding material and the filling rate of the fluoride powder in the layer can be identified by cutting the radiation shielding material along the incident direction of radiation and observing a backscattered electron composition image of the obtained cross-section by a scanning electron microscope (SEM). In the backscattered electron composition image, because the density of the fluoride powder and the density of the resin are significantly different, it is possible to observe the layer in which there is the fluoride powder with the clear contrast.

The thickness of the layer in which there is the fluoride powder is measured by using a length measuring function of SEM which is calibrated with a standard grid whose interval is known. The filling rate of the fluoride powder in the layer is calculated by the following expression.

$$\text{Filling rate (vol \%)}=1/\{(\rho_f/\rho_p)/(W_f/W_p)+1\}\times t_t/t_c\times 100$$

Where $\rho_f$ and $\rho_p$ respectively represent the densities of the fluoride powder and the resin, $W_f$ and $W_p$ respectively represent the weights of the fluoride powder and the resin contained in the radiation shielding material, and $t_t$ and $t_c$ respectively represent the thickness of the entire radiation shielding material and the thickness of the layer in which there is the fluoride powder.

The thickness of the layer and the filling rate are measured at arbitrary dozens of places, and an average value of the obtained values is used.

[Method of Measuring Radiation Shielding Performance]

The shielding performance of the radiation shielding material can be evaluated by measuring the radiation transmittance with the following method. A radiation source that emits radiation to be shielded and a radiation detector that detects the radiation are caused to face with each other at a predetermined distance, and radiation intensity C0 without shielding material placed therebetween is obtained. Next, radiation intensity C1 with the radiation shielding material placed between the radiation source and the radiation detector is obtained. The radiation transmittance is obtained by using the obtained C0 and C1 and the following expression.

$$\text{Radiation transmittance (\%)}=C1/C0\times 100$$

Further, by a person skilled in the art, the shielding performance of the radiation shielding material is generally evaluated by using the thickness of lead that gives shielding performance equivalent thereto (lead equivalent). The lead equivalent can be obtained by the following method. First, lead plates having various thicknesses are prepared, and the respective radiation transmittances of the lead plates are measured similarly to the above. Because the radiation transmittance and the thickness of the lead plate has a relationship represented by the following expression, regression analysis is performed using the thickness of the lead plate used for the measurement and the obtained radiation transmittance, and thus, an attenuation coefficient is obtained.

$$T=e^{-\mu t}$$

Where T represents the radiation transmittance, μ represents the attenuation coefficient ($mm^{-1}$), and t represents the thickness of the lead plate (mm).

Next, the radiation transmittance of the radiation shielding material is measured, and the lead equivalent is obtained by substituting the radiation transmittance into the following expression.

$$\text{Lead equivalent (mmPb)}=-\ln(T)/\mu$$

[Method of Measuring Haze]

The haze of the radiation shielding material can be measured by a method defined in Japanese Industrial Standards (JIS K 7136). Measurement apparatuses that conform to the standards are commercially available and can be used without limitation.

Example

Hereinafter, examples are shown in order to describe the embodiment of the present disclosure more specifically. However, the present invention is not limited to these examples.

Example 1

A Bulk LiF raw material and $BaF_2$ raw material obtained by melting and solidifying LiF powder and $BaF_2$ powder were mixed so that the molar ratio of LiF:$BaF_2$ was 0.57:0.43 and the total amount of the raw materials was 3 kg, and charged in a crucible made of carbon having the inner diameter of 120 mm, and it was placed in a Czochralski crystal growth furnace (CZ furnace). Next, the degree of vacuum in the furnace was maintained to be not more than $1\times10^{-3}$ Pa, the crucible was heated to 600° C. over 24 hours, $CF_4$ gas having a purity of 99.999% was introduced into the furnace, and the pressure inside the furnace was set to 80 kPa. After that, the crucible was heated to 900° C. over 2 hours and the mixture was melted.

Next, a seed crystal formed of a $BaLiF_3$ single crystal, whose vertical direction was <111> direction, was caused to be brought into contact with the raw material melt in the crucible, and an ingot formed of a $BaLiF_3$ single crystal body was caused to grow by pulling this seed crystal at the speed of 1.0 mm/h while rotating at 15 rpm. After the ingot formed of a $BaLiF_3$ single crystal body was caused to grow to a predetermined size, the ingot was cut off from the melt. Next, after the CZ furnace was cooled over 36 hours, the ingot was taken out from the CZ furnace. The total length, the length of the straight body part, and the diameter of the straight body part of the obtained ingot were respectively 130 mm, 100 mm, and 50 mm.

The density and refractive index of the obtained $BaLiF_3$ single crystal body were respectively 5.2 g/mL and 1.54. A transparent part of the single crystal body was cut out, finely pulverized by using a pulverizer, and caused to pass through a sieve with a mesh size of 200 μm, and the sieved portion was collected to obtain BaF powder 1. The average particle diameter of the BaF powder 1 was 120 μm. Next, 300 g of polyvinyl chloride resin (PVC) having a refractive index of 1.54 was mixed with 3000 g of the BaF powder 1, and the resulting mixture was kneaded by using a Banbury mixer to obtain a radiation shielding material formed of a resin composition containing 72.6 vol % of the BaF powder 1. This radiation shielding material was molded by a pressure press machine, and thus, a radiation shielding material of 100 mm×100 mm having a thickness of 4 mm was obtained. This radiation shielding material had transparency, and the total light transmittance and haze thereof were respectively 91% and 32%.

Next, the radiation transmittance of the prepared radiation shielding material was measured by the following method. Specifically, a γ-ray generation source, Cs-137, that generates γ-rays of 611 keV and a NaI-R6249 γ-ray detector are caused to face with each other at a distance of 30 cm, and γ-ray intensity C0 without shielding material placed therebetween is obtained. Next, γ-ray intensity C1 with the prepared radiation shielding material placed 3 cm in front of the γ-ray detector between the γ-ray source and the γ-ray detector is obtained. The radiation transmittance was obtained by using the following expression.

$$\text{Radiation transmittance (\%)}=C1/C0\times100$$

When the radiation shielding material prepared in this example was evaluated by the above-mentioned method, the radiation transmittance was 88% and the radiation shielding performance (lead equivalent) was 1.2 mmPb.

When the cross-section of the obtained radiation shielding material was observed by using a SEM and the thickness of the layer in which there is the fluoride powder (filling layer) and the filling rate of the fluoride powder in the layer were measured, the thickness was 4.0 mm and the filling rate was 73 vol %.

Example 2

With BaF2 being a raw material, a single crystal body was prepared by the method similar to that in the example 1. 3 kg of $BaF_2$ powder was charged in a crucible made of carbon having the inner diameter of 120 mm, and it was placed in a Czochralski crystal growth furnace (CZ furnace). Next, the degree of vacuum in the furnace was maintained to be not more than $1\times10^{-3}$ Pa, the crucible was heated to 600° C. over 24 hours, $CF_4$ gas having a purity of 99.999% was introduced into the furnace, and the pressure inside the furnace was set to 80 kPa. After that, the crucible was heated to 1400° C. over 2 hours and the mixture was melted. Next, a seed crystal formed of a $BaF_2$ single crystal, whose vertical direction was <111> direction, was caused to be brought into contact with the raw material melt in the crucible, and an ingot formed of a $BaF_2$ single crystal body was caused to grow by pulling this seed crystal at the speed of 2.0 mm/h while rotating at 15 rpm. After the ingot formed of a $BaF_2$ single crystal body was caused to grow to a predetermined size, the ingot was cut off from the melt. Next, after the CZ furnace was cooled over 36 hours, the ingot was taken out from the CZ furnace. The total length, the length of the straight body part, and the diameter of the straight body part of the obtained ingot were respectively 130 mm, 100 mm, and 50 mm.

The density and refractive index of the obtained $BaF_2$ single crystal body were respectively 4.8 g/mL and 1.48. This was finely pulverized by using a pulverizer and caused to pass through a sieve with a mesh size of 200 μm, and the sieved portion was collected to obtain BaF powder 2. The average particle diameter of the BaF powder 2 was 108 μm.

Next, 300 g of polyvinyl chloride resin powder (having a refractive index of 1.54) was premixed with 3000 g of the BaF powder 2, and the resulting mixture was melted and mixed by using a Banbury mixer to obtain a radiation shielding material formed of a resin composition containing 74.1 vol % of the BaF powder 2. This radiation shielding material was molded by a pressure press machine, and thus, a radiation shielding material of 100 mm×100 mm having a thickness of 4 mm was obtained.

The obtained radiation shielding material had transparency, and the total light transmittance and haze thereof were respectively 65% and 38%.

Next, when the radiation transmittance of the obtained radiation shielding material was measured in the same way as that in the example 1, the radiation transmittance was 88% and the radiation shielding performance (lead equivalent) was 1.2 mmPb.

When the cross-section of the obtained radiation shielding material was observed by using a SEM and the thickness of the layer in which there is the fluoride powder (filling layer) and the filling rate of the fluoride powder in the layer were measured, the thickness was 4.0 mm and the filling rate was 74 vol %.

Example 3

In this example, solid solution powder formed of $BaF_2$ and $LaF_3$ was used as fluoride powder, and polyvinyl chloride was used as resin. The refractive indices of the fluoride powder and the resin are respectively 1.54 and 1.54, and the difference between the refractive indices is 0.00.

The $BaF_2$ powder and $LaF_3$ powder were mixed so that the molar ratio of $BaF_2$:$LaF_3$ was 0.5:0.5 and the total amount thereof was 3 kg, and thus, a raw material of fluoride powder was obtained. The raw material of fluoride powder was charged in a crucible made of carbon having the inner diameter of 400 mm, and it was placed in a melting furnace. Next, the degree of vacuum in the furnace was maintained to be not more than $1\times10^{-3}$ Pa, the crucible was heated to 600° C. over 24 hours, $CF_4$ gas having a purity of 99.999% was introduced into the furnace, and the pressure inside the furnace was set to 80 kPa. After that, the crucible was heated to melting temperature of 1500° C. over 2 hours, and the mixture was melted. After it was held for 3 hours at the melting temperature, the mixture was slowly cooled to room temperature over 12 hours to be solidified, and an ingot of a solid solution formed of $BaF_2$ and $LaF_3$ (hereinafter, referred to also as $BaF_2$—$LaF_3$) was obtained. The density of the $BaF_2$—$LaF_3$ was 5.4 g/mL.

The ingot of $BaF_2$—$LaF_3$ was finely pulverized by using a pulverizer and caused to pass through a sieve with a mesh size of 200 and the sieved portion was collected to obtain $BaF_2$—$LaF_3$ powder. The average particle diameter of the powder was 115

300 g of polyvinyl chloride resin powder (having a refractive index of 1.54) was premixed with 3000 g of the $BaF_2$—$LaF_3$ powder, and the resulting mixture was melted and mixed by using a Banbury mixer to obtain a radiation shielding material formed of a resin composition containing 72.2 vol % of the $BaF_2$—$LaF_3$ powder. This radiation shielding material was molded by a pressure press machine, and thus, a radiation shielding material of 100 mm×100 mm having a thickness of 4 mm was obtained.

The obtained radiation shielding material had transparency, and the total light transmittance and haze thereof were respectively 94% and 20%.

Next, when the radiation transmittance of the obtained radiation shielding material was measured in the same way as that in the example 1, the radiation transmittance was 87% and the radiation shielding performance (lead equivalent) was 1.3 mmPb.

When the cross-section of the obtained radiation shielding material was observed by using a SEM and the thickness of the layer in which there is the fluoride powder (filling layer) and the filling rate of the fluoride powder in the layer were measured, the thickness was 4.0 mm and the filling rate was 72 vol %.

Example 4

In this example, $BaY_2F_8$ powder was used as fluoride powder and a copolymer formed of 25 wt % of ethoxylated bisphenol A dimethacrylate and 75 wt % of triethylene glycol dimethacrylate was used as resin. The refractive indices of the fluoride powder and resin are respectively 1.52 and 1.52, and the difference between the refractive indices is 0.00. An ingot of $BaY_2F_8$ was obtained in the way similar to that of the Example 3 except that a raw material of fluoride powder obtained by mixing the $BaF_2$ powder and $YF_3$ powder so that the molar ratio of $BaF_2$:$YF_3$ was 1:2 and the total amount thereof was 3 kg was used, and the melting temperature was 1100° C. The density of the $BaY_2F_8$ was 5.0 g/mL. Next, the ingot of $BaY_2F_8$ was pulverized in the way similar to that in the example 3 and caused to pass through a sieve, and thus, $BaY_2F_8$ powder was obtained. The average particle diameter of the powder was 118 μm.

Next, 300 g of liquid resin obtained by mixing 25 wt % of ethoxylated bisphenol A dimethacrylate and 75 wt % of triethylene glycol dimethacrylate was mixed with 3000 g of $BaY_2F_8$ powder, and air bubbles were removed by vacuum degassing. The obtained mixture of the fluoride powder and liquid resin was poured into a mold of 100 mm×100 mm having a thickness of 4.5 mm, and the liquid resin was cured to obtain a radiation shielding material of 100 mm×100 mm having a thickness of 4.5 mm.

The obtained radiation shielding material had transparency, and the total light transmittance and haze thereof were respectively 92% and 25%.

Next, when the radiation transmittance of the obtained radiation shielding material was measured in the same way as that in the example 1, the radiation transmittance was 88% and the radiation shielding performance (lead equivalent) was 1.2 mmPb.

When the cross-section of the obtained radiation shielding material was observed by using a SEM and the thickness of the layer in which there is the fluoride powder (filling layer) and the filling rate of the fluoride powder in the layer were measured, the thickness was 4.0 mm and the filling rate was 79 vol %.

Example 5

In this example, $YbF_3$ powder was used as fluoride powder and polyethoxylated bisphenol A dimethacrylate was used as resin. The refractive indices of the fluoride powder and resin are respectively 1.60 and 1.58, and the difference between the refractive indices is 0.02.

An ingot of $YbF_3$ was obtained in the way similar to that of the Example 3 except that 3 kg of $YbF_3$ fine powder raw material was used as a raw material of fluoride powder and the melting temperature was 1300° C. The density of the $YbF_3$ was 8.2 g/mL. Next, the ingot of $YbF_3$ was pulverized in the way similar to that in the example 3 and caused to pass through a sieve, and thus, $YbF_3$ powder was obtained. The average particle diameter of the powder was 105 μm.

Next, a radiation shielding material of 100 mm×100 mm having a thickness of 4.5 mm was obtained in the same way as that in the example 4 except that 300 g of ethoxylated bisphenol A dimethacrylate was mixed with 3600 g of $YbF_3$.

The obtained radiation shielding material had transparency, and the total light transmittance and haze thereof were respectively 75% and 33%.

Next, when the radiation transmittance of the obtained radiation shielding material was measured in the same way as that in the example 1, the radiation transmittance was 84% and the radiation shielding performance (lead equivalent) was 1.7 mmPb.

Next, when the radiation transmittance of the obtained radiation shielding material was measured in the same way as that in the example 1, the radiation transmittance was 89% and the radiation shielding performance (lead equivalent) was 1.1 mmPb.

When the cross-section of the obtained radiation shielding material was observed by using a SEM and the thickness of the layer in which there is the fluoride powder (filling layer) and the filling rate of the fluoride powder in the layer were measured, the thickness was 4.0 mm and the filling rate was 74 vol %.

Table 1 collectively shows evaluation results of the examples 1 to 6.

TABLE 1

| | | Example 1 | Example 2 | Example 3 | Example 4 | Example 5 | Example 6 |
|---|---|---|---|---|---|---|---|
| Metal fluoride | Kind | $BaLiF_3$ | $BaF_2$ | $BaF_2$—$BaLiF_3$[1)] | $BaY_2F_8$ | $YbF_3$ | $BaF_2$ |
| | Embodiment | Composite fluoride | Simple fluoride | Solid solution | Composite fluoride | Simple fluoride | Simple fluoride |
| | Density (g/cm$^3$) | 5.2 | 4.8 | 5.4 | 5.0 | 8.2 | 4.8 |
| | Refractive index ($n_D$) | 1.54 | 1.48 | 1.54 | 1.52 | 1.60 | 1.48 |
| | Average particle diameter (μm) | 120 | 108 | 115 | 118 | 105 | 108 |
| Resin | Kind | Polyvinyl chloride | Polyvinyl chloride | Polyvinyl chloride | Composite resin[2)] | Polyethoxylated bisphenolA dimethacrylate | Silicone |
| | Refractive index ($n_D$) | 1.54 | 1.54 | 1.54 | 1.52 | 1.58 | 1.41 |
| Difference between refractive indices of metal fluoride and resin | | 0.00 | 0.06 | 0.00 | 0.00 | 0.02 | 0.07 |
| Fluoride filling layer | Filling rate (vol %) | 73 | 74 | 72 | 79 | 72 | 74 |
| | Thickness (mm) | 4.0 | 4.0 | 4.0 | 4.0 | 4.0 | 4.0 |
| Transparency | Total light transmittance (%) | 91 | 65 | 94 | 92 | 75 | 65 |
| | Haze (%) | 32 | 38 | 20 | 25 | 33 | 40 |
| Radiation transmittance (%) | | 88 | 88 | 87 | 88 | 84 | 89 |
| Radiation shielding performance (mmPb) | | 1.2 | 1.2 | 1.3 | 1.2 | 1.7 | 1.1 |

[1)]Solid solution in which molar ratio of $BaF_2$:$LaF_3$ is 0.5:0.5

[2)]Copolymer formed of 25 wt % of ethoxylated bisphenol A dimethacrylate and 75 wt % of triethylene glycol dimethacrylate When the cross-section of the obtained radiation shielding material was observed by using a SEM and the thickness of the layer in which there is the fluoride powder (filling layer) and the filling rate of the fluoride powder in the layer were measured, the thickness was 4.0 mm and the filling rate was 72 vol %.

Example 6

In this example, the BaF powder 2 (having a density of 4.8 g/mL) was used as fluoride powder and silicone was used as resin. The refractive indices of the fluoride powder and resin are respectively 1.48 and 1.41, and the difference between the refractive indices is 0.07. The average particle diameter of the BaF powder 2 was 108 μm.

300 g of liquid silicone was mixed with 2500 g of the BaF powder 2, and air bubbles were removed by vacuum degassing. The obtained mixture of the fluoride powder and liquid silicone was poured into a mold of 100 mm×100 mm having a thickness of 4.5 mm, and silicone was cured to obtain a radiation shielding material of 100 mm×100 mm having a thickness of 4.5 mm.

The obtained radiation shielding material had transparency, and the total light transmittance and haze thereof were respectively 65% and 40%.

Comparative Example 1

In this comparative example, $CaF_2$ powder having a density of 3.2 g/mL was used as fluoride powder and silicone was used as resin. The refractive indices of the fluoride powder and resin are respectively 1.43 and 1.41, and the difference between the refractive indices is 0.02.

An ingot of $CaF_2$ was obtained in the way similar to that of the example 3 except that 3 kg of $CaF_2$ fine powder raw material was used as a raw material of fluoride powder. The density of the $CaF_2$ was 3.2 g/mL. Next, the ingot of $CaF_2$ was pulverized in the way similar to that in the example 3, and caused to pass through a sieve, and thus, $CaF_2$ powder was obtained. The average particle diameter of the powder was 123 μm.

Next, a radiation shielding material of 100 mm×100 mm having a thickness of 4.5 mm was obtained in the way similar to that in the example 6 except that 300 g of liquid silicone was mixed with 1700 g of $CaF_2$ powder.

The thickness of the layer in which there is the fluoride powder in the obtained radiation shielding material, the filling rate of fluoride powder in the layer, the total light transmittance, the haze, the radiation transmittance, and the radiation shielding performance are shown in Table 2.

Because the density of fluoride powder is small, i.e., 3.2 g/mL, only the radiation shielding performance less than 1 mmPb was obtained.

Comparative Example 2

In this comparative example, the BaF powder 1 was used as fluoride powder and silicone was used as resin. The refractive indices of the fluoride powder and resin are respectively 1.54 and 1.41, and the difference between the refractive indices is 0.13.

A radiation shielding material of 100 mm×100 mm having a thickness of 4.5 mm was obtained in the way similar to that of the example 6 except that 300 g of liquid silicone was mixed with 2500 g of the BaF powder 1.

The thickness of the layer in which there is the fluoride powder in the obtained radiation shielding material, the filling rate of fluoride powder in the layer, the total light transmittance, the haze, the radiation transmittance, and the radiation shielding performance are shown in Table 2. Because the difference between refractive indices of the fluoride powder and resin was large, i.e., 0.13, the transparency was low (total light transmittance of 57% and haze of 62%).

Comparative Example 3

In this comparative example, a radiation shielding material of 100 mm×100 mm having a thickness of 4 mm was obtained in the way similar to that of the example 1 except that 300 g of polyvinyl chloride resin was mixed with 450 g of the BaF powder 1 and a resin composition containing 28.8 vol % of the BaF powder 1 was prepared.

The thickness of the layer in which there is the fluoride powder in the obtained radiation shielding material, the filling rate of fluoride powder in the layer, the total light transmittance, the haze, the radiation transmittance, and the radiation shielding performance are shown in Table 2. Because the filling rate (29%) of the fluoride powder was low, only the radiation shielding performance less than 1 mmPb was obtained.

Comparative Example 4

In this comparative example, $Yb_2O_3$ powder was used as fluoride powder and a polymer of ethoxylated bisphenol A dimethacrylate was used as resin. The refractive indices of the fluoride powder and resin are respectively 1.95 and 1.58, and the difference between the refractive indices is 0.37.

A $Yb_2O_3$ fine powder raw material was filled in a crucible made of rhenium having the inner diameter of 80 mm, and it was housed in a melting furnace. Next, while maintaining the pressure inside the furnace at the atmospheric pressure by causing gas of 0.01% of $O_2$, 10% of $H_2$, and 90% of $N_2$ to flow in the furnace, the crucible was heated to the melting temperature of 2500° C. over 8 hours, and the above-mentioned mixture was melted. After it was held for 3 hours at the melting temperature, the mixture was slowly cooled to room temperature over 12 hours to be solidified, and an ingot of $Yb_2O_3$ was obtained. The density of the ingot of $Yb_2O_3$ was 9.2 g/mL.

The ingot of $Yb_2O_3$ was finely pulverized by using a pulverizer and caused to pass through a sieve with a mesh size of 200 μm, and the sieved portion was collected to obtain $Yb_2O_3$ powder. The average particle diameter of the powder was 125 μm.

Next, a radiation shielding material of 100 mm×100 mm having a thickness of 4.5 mm was obtained in the way similar to that in the example 5 except that 50 g of ethoxylated bisphenol A dimethacrylate was mixed with 670 g of $Yb_2O_3$.

The thickness of the layer in which there is the $Yb_2O_3$ powder in the obtained radiation shielding material, the filling rate of $Yb_2O_3$ powder in the layer, the total light transmittance, the haze, the radiation transmittance, and the radiation shielding performance are shown in Table 2. Because the difference between refractive indices of the fluoride powder and resin was very large, i.e., 0.37, the transparency was low (total light transmittance of 51% and haze of 85%).

Comparative Example 5

In this comparative example, a radiation shielding material obtained by filling $BaSO_4$ powder in polyvinyl chloride resin was prepared. The refractive indices of the $BaSO_4$ powder and polyvinyl chloride resin are respectively 1.64 and 1.54, and the difference between the refractive indices is 0.10.

A radiation shielding material of 100 mm×100 mm having a thickness of 4 mm was obtained in the way similar to that in the example 1 except that 300 g of polyvinyl chloride resin is mixed with 2700 g of commercially available $BaSO_4$ powder (having an average particle diameter of 15 μm).

The thickness of the layer in which there is the $BaSO_4$ powder in the obtained radiation shielding material, the filling rate of $BaSO_4$ powder in the layer, the total light transmittance, the haze, the radiation transmittance, and the radiation shielding performance are shown in Table 2. Although a certain level of radiation shielding effect (1.1 mmPb) was achieved, the transparency was low as compared with the examples 1 to 6 (total light transmittance of 59% and haze of 61%).

TABLE 2

| | | Comparative example 1 | Comparative example 2 | Comparative example 3 | Comparative example 4 | Comparative example 5 |
|---|---|---|---|---|---|---|
| Metal fluoride | Kind | $CaF_2$ | $BaLiF_3$ | $BaLiF_3$ | $Yb_2O_3$ | $BaSO_4$ |
| | Embodiment | Simple fluoride | Composite fluoride | Composite fluoride | Oxide | Sulfate |
| | Density (g/cm$^3$) | 3.2 | 5.2 | 5.2 | 9.2 | 4.5 |
| | Refractive index ($n_D$) | 1.43 | 1.54 | 1.54 | 1.95 | 1.64 |
| | Average particle diameter (μm) | 123 | 120 | 120 | 125 | 15 |
| Resin | Kind | Silicone | Silicone | Polyvinyl chloride | Polyethoxylated bisphenol A dimethacrylate | Polyvinyl chloride |
| | Refractive index ($n_D$) | 1.41 | 1.41 | 1.54 | 1.58 | 1.54 |

TABLE 2-continued

| | | Comparative example 1 | Comparative example 2 | Comparative example 3 | Comparative example 4 | Comparative example 5 |
|---|---|---|---|---|---|---|
| Difference between refractive indices of metal fluoride and resin | | 0.02 | 0.13 | 0.00 | 0.37 | 0.10 |
| Fluoride filling layer[1]) | Filling rate (vol %) | 74 | 72 | 29 | 72 | 74 |
| | Thickness (mm) | 4.0 | 3.9 | 4.0 | 4.0 | 3.8 |
| Transparency | Total light transmittance (%) | 78 | 57 | 93 | 51 | 59 |
| | Haze (%) | 30 | 62 | 22 | 85 | 61 |
| Radiation transmittance (%) | | 93 | 89 | 93 | 82 | 90 |
| Radiation shielding performance (mmPb) | | 0.7 | 1.1 | 0.7 | 1.9 | 1.1 |

[1])Layer in which there are $Yb_2O_3$ and $BaSO_4$ in comparative examples 4 and 5, respectively

The invention claimed is:

1. A radiation shielding material, comprising:

a resin composition containing a proportion of 20 to 80 vol % of fluoride powder containing barium as a constituent element, wherein a difference between a refractive index of resin constituting the resin composition and a refractive index of the fluoride powder is within ±0.05.

2. The radiation shielding material according to claim 1, wherein the fluoride powder is barium fluoride or lithium barium fluoride.

3. The radiation shielding material according to claim 1, wherein resin constituting the resin composition has a refractive index of 1.4 to 1.6.

4. The radiation shielding material according to claim 1, wherein an average particle diameter of the fluoride powder is 10 to 500 μm.

5. A radiation shielding material formed of a molded body, the molded body including a filling layer formed of a resin composition obtained by filling metal fluoride powder in resin, wherein a density of the metal fluoride powder is not less than 4.6 $g/cm^3$, a difference between a refractive index of the resin and a refractive index of the metal fluoride powder is within ±0.07, and a part or whole of the filling layer in a thickness direction includes a layer in which a filling rate of the metal fluoride powder is not less than 40 vol %.

6. The radiation shielding material according to claim 5, wherein metal fluoride constituting the metal fluoride powder is formed of simple metal fluoride or a solid solution of a plurality of metal fluorides.

7. The radiation shielding material according to claim 5, wherein a particle shape of the metal fluoride powder is a spherical shape.

8. The radiation shielding material according to claim 5, wherein the refractive index of the resin is not less than 1.4 and not more than 1.6.

9. The radiation shielding material according to claim 8, wherein the resin is epoxy resin, vinyl chloride resin, acrylic resin, cycloolefin resin, or silicone resin.

10. The radiation shielding material according to claim 5, wherein a total light transmittance of the molded body is not less than 65%.

11. The radiation shielding material according to claim 5, wherein a haze of the molded body is not more than 40%.

12. The radiation shielding material according to claim 5, wherein a lead equivalent of the molded body is not less than 1.0 mmPb.

13. The radiation shielding material according to claim 5, wherein the molded body is a lens part of goggles or spectacles.

14. The radiation shielding material according to claim 5, wherein the molded body is a pipe for transporting liquid containing a radioactive substance.

15. The radiation shielding material according to claim 5, wherein the molded body is a radiation shielding sheet.

16. The radiation shielding material according to claim 5, wherein the molded body is a syringe for radioactive substance-containing liquid.

17. A production method for a radiation shielding material, comprising:

preparing resin and metal fluoride powder, a difference between a refractive index of the resin and a refractive index of the metal fluoride powder being within +0.07, a density of the metal fluoride powder being not less than 4.6 $g/cm^3$;

preparing a resin composition including the resin and the metal fluoride powder; and molding the resin composition, at least a part of the resin composition including a layer in which a filling rate of the metal fluoride powder being not less than 40 vol %.

18. The production method according to claim 17, wherein the preparing the metal fluoride powder includes adjusting a refractive index of the metal fluoride powder by making solid solution of the metal fluorides.

19. The production method according to claim 17, wherein the preparing the resin includes adjusting a refractive index of the resin by a mixture of resins having different refractive indices.

* * * * *